US006283719B1

(12) United States Patent
Frantz et al.

(10) Patent No.: US 6,283,719 B1
(45) Date of Patent: Sep. 4, 2001

(54) DETECTING OBSTRUCTIONS IN ENTERAL/ PARENTERAL FEEDING TUBES AND AUTOMATIC REMOVAL OF CLOGS THEREFROM

(75) Inventors: Mark G. Frantz, New York, NY (US); Mark R. Honard, Mentor, OH (US); Patrick Manzie, Mayfield Hts., OH (US); Thomas J. Pavsek, Mentor, OH (US); Charlie P. Chesnes, Chardon, OH (US); Richard E. Nemer, Fairlawn, OH (US)

(73) Assignee: Frantz Medical Development LTD, New York, NY (US)

( * ) Notice: Subject to any disclaimer, the term of this patent is extended or adjusted under 35 U.S.C. 154(b) by 0 days.

(21) Appl. No.: 09/186,794

(22) Filed: Nov. 5, 1998

(51) Int. Cl.[7] ..... F04B 19/24
(52) U.S. Cl. ..... 417/53; 417/63; 604/123
(58) Field of Search ..... 417/53, 63, 44.2, 417/412, 413.1, 413.2, 472, 566; 604/123, 153

(56) References Cited

U.S. PATENT DOCUMENTS

| | | | | |
|---|---|---|---|---|
| 4,256,437 | * | 3/1981 | Brown | 417/45 |
| 4,845,487 | | 7/1989 | Frantz et al. | 604/67 |
| 4,850,807 | | 7/1989 | Frantz et al. | 417/63 |
| 4,882,575 | | 11/1989 | Kawahara | 340/608 |
| 4,977,517 | | 12/1990 | Gibbs et al. | 364/510 |
| 5,103,211 | * | 4/1992 | Daoud et al. | 417/63 |
| 5,237,309 | * | 8/1993 | Frantz et al. | 340/679 |
| 5,514,102 | | 5/1996 | Winterer et al. | 340/679 |
| 5,720,721 | | 2/1998 | Dumas et al. | 604/67 |

OTHER PUBLICATIONS

J. M. Hofstetter, "Non–Medication Induced Nasogastric Tube Occlusion: Mechanism Determination and Resolution Studies", Master of Science Thesis, 1989, University of Oklahoma.

Ross Laboratories; Flexiflo® Quantum™ Enteral Pump; Operating Manual, 1993.

* cited by examiner

*Primary Examiner*—Henry C. Yuen
*Assistant Examiner*—Mahmoud Gimie
(74) *Attorney, Agent, or Firm*—Frishauf, Holtz, Goodman, Langer & Chick, PC

(57) ABSTRACT

A tube in a pumped fluid system can become obstructed by a clog. The clog is automatically cleared in response to an obstruction signal by modifying the pumping cycle which is normally used to pump the fluid. In particular, the pumping cycle is stopped after a compression stroke to apply sustained high pressure in the clogged tube, using the same fluid and the same pump, to expel the clog from the tube. The obstruction signal is derived by measuring pressure during a portion of the pumping cycle when elevated pressure due to viscosity effects have subsided. Therefore, if the pressure remains elevated, a determination of an obstructed state can reliably be made which may be caused by a clog.

41 Claims, 8 Drawing Sheets

LEGEND
A - NORMAL UNCLOGGED
B - CLOGGED
C - VISCOUS UNCLOGGED

LEGEND

| | |
|---|---|
| BDC' - TDC | COMPRESSION |
| TDC - BDC | RETRACTION |
| BDC - BDC' | TIMED DELAY |

LEGEND

| | |
|---|---|
| BDC' - TDC | COMPRESSION |
| TDC - TDC' | TDC PAUSE |
| TDC' - BDC | RETRACTION |
| BDC - BDC' | TIMED DELAY |

DETECTING OBSTRUCTIONS IN ENTERAL/PARENTERAL FEEDING TUBES AND AUTOMATIC REMOVAL OF CLOGS THEREFROM

BACKGROUND OF THE INVENTION

The present invention relates to detecting an obstruction in a feeding tube of a pumped fluid system which provides fluid to a patient during a pumping cycle, and automatically removing a detected clog in the feeding tube by modifying the pumping cycle for controlling the pumping of the fluid.

U.S. Pat. Nos. 4,845,487 and 4,850,807 disclose features of a feeding system to provide nutritional fluid and medication to a patient either enterally through the alimentary canal or parenterally via an intravenous catheter. Such systems are referred to herein as pumped fluid systems. The entire contents of these patents are incorporated herein by reference, and a summary thereof is presented below.

As shown in FIG. 1, a pumped fluid system for fluid control and delivery includes a reservoir 1 for storing a fluid, and a pump supply tube 2 interconnecting the reservoir 1 and a cassette 3 (described below) which is adapted to be inserted into a receiving chamber 4 within a pump-and-control housing 5. The fluid flows down the pump supply tube 2 and into the cassette 3, and is then pumped through a feeding tube 6 into the patient.

As shown in FIG. 2, the cassette 3 is preferably provided with a compressible member such as bellows 7 for drawing fluid thereinto from tube 2 as the bellows expands and for forcing a repeatable, metered volume of the fluid into the feeding tube 6 and on into the patient as the bellows contracts. The cassette 3 includes valve 8 which allows fluid to flow from tube 2 into bellows 7 and valve 9 which enables flow of fluid from bellows 7 into the feeding tube 6. Both of these valves block backflow. Valve 8 blocks backflow through tube 2 into reservoir 1, whereas valve 9 blocks backflow into bellows 7 from feeding tube 6.

As shown in FIG. 3, pump-and-control housing 5 includes a motor 10 which rotates a cam (not shown) and thereby causes a cam follower or piston 11 to compress the cassette bellows 7 (cassette 3 is not shown in FIG. 3, but the bellows 7 would be so engageable when the cassette is inserted into chamber 4) and thereby force the feeding fluid into the feeding tube 6. A pressure sensor, which can be a piezoelectric electric transducer 12, is provided between the cassette bellows 7 and the piston 11 for measuring the pressure therebetween in order to detect obstructions in the tubing.

The flow rate of fluid to the patient may be controlled by setting the pump motor 10 to an intermittent pumping mode for pulsatile flow. Intermittent pumping involves a two stroke pumping cycle whereby the pumping chamber (i.e., the cassette bellows 7) is first filled with fluid during a retraction stroke (as piston 11 is retracted and the bellows expands) and then the fluid is expelled into the feeding tube 6 and on into the patient during a compression stroke (as piston 11 is extended and the bellows contracts). The pumping cycle is provided with a timed delay at the end of the retraction stroke by stopping motor 10 for a time period sufficient to allow the pumping chamber to fill with fluid. This period of time is also adjusted by the operator in a well known manner such that the number of cycles during a given time period multiplied by the amount of fluid in the pumping chamber expelled with each compression produces a desired flow rate for providing fluid to the patient. Typical flow rates may range from 1 ml/hr. to 300 ml/hr.

As discussed by J. M. Hofstetter in "Non-Medication Induced Nasogastric Tube Occlusion: Mechanism Determination and Resolution Studies", enteral feeding systems have the tendency, over the duration of patient feeding, to form clogs in their indwelling tubes. The tubes for enteral feeding may be of a nasogastric or gastrostomy type and are generally 8 french or larger.

Medications are commonly added to the fluid from time to time during the feeding of a patient and may temporarily increase the overall viscosity of the fluid until the medication, mixed with the fluid, has been expelled from the tube into the patient.

Poiseuille's Law, which is described in the *Chemical Engineer's Handbook*, Fifth Edition, at pages 5–25, indicates that fluids with higher viscosity will produce higher pressures in the tube during pumping. More specifically, during the compression stroke, the pressure within the pumping chamber and feeding tube increases as fluid is forced out of the chamber and through the tube. During the retraction stroke, while the pumping chamber fills with fluid from the reservoir, the pressure in the feeding tube will decrease as the fluid flows out of it, if the feeding tube is not clogged.

Because pumped fluid systems, such as ones using enteral feeding tubes, their connecting tubes and other compliant components (such as pumping chamber and valves) which connect to the pump, are made of flexible materials and because the feeding fluid is essentially incompressible, these components of such systems enlarge in response to increased pressure during the compression stroke of pumping. This effect is magnified with increasing fluid viscosity in accordance with Poiseuille's Law. The feeding tube and other compliant components relax by returning to their normal size as fluid flows out of the feeding tube.

FIG. 4 illustrates the buildup and dissipation of pressure in the feeding tube 6 with respect to the pumping cycle during a normal state of pumping when no clogs are present in the feeding tube. Starting at point BDC' (i.e. the time when the piston rests on Bottom Dead Center of the cam rotated by motor 10), where the pumping chamber is relaxed and filled with fluid and the compression stroke is to begin, the pressure rises as the cam rotates and the pumping chamber is compressed so that fluid is forced into the feeding tube. TDC (i.e. the time when Top Dead Center is reached) is the point where the pumping chamber is fully compressed. During the retraction stroke between points TDC and BDC, fluid continues to flow out of the tube into the patient, and pressure drops to near zero. Also, fluid is drawn into the chamber during the retraction stroke. There is a timed delay at the end of the retraction stroke which occurs between points BDC and BDC' to ensure that the pumping chamber is fully filled with fluid, even for a viscous fluid, and to control flow rate.

The output amplitude of piezoelectric transducer 12 is directly related to the pressure applied thereto. More specifically, the output signal from a piezoelectric transducer is directly dependent on the rate of change of force applied thereto. If the force is constant, the output signal from the piezoelectric transducer will be zero no matter how large the force is. When the force is changed, however, the magnitude of the output signal from the piezoelectric crystal will be directly dependent on the absolute magnitude of the applied changing force. FIG. 5 shows the output of piezoelectric transducer 12 for the normal pumping cycle discussed above in relation to FIG. 4.

If piston 11 encounters more than usual resistance in compressing bellows 7, the output of piezoelectric transducer 12 will increase in amplitude. Such higher amplitude of the transducer output can be due either to the formation of an obstruction in the tube or to an increase in fluid viscosity.

With the pumping mechanisms of known pumped fluid systems it has not been possible to reliably discriminate between (1) an increase in fluid viscosity and (2) the formation of an obstruction such as a clog. As a result, it is difficult to set a fixed threshold for distinguishing increased pressure due to clogs from the increased pressure which results from normal pumping of higher viscosity fluids, particularly such as those to which medications have been added.

Conventionally, an alarm is provided for alerting a nurse or other operator that the patient is not receiving fluid due to an obstruction. When the alarm is triggered, the pump terminates its pumping mode. The nurse or other operator then follows an intervention protocol that typically includes the following measures. First, the feeding tube is examined to make certain that it is free of obstruction caused by twisting or crimping or because the patient or some other object is lying on the tubing and thereby closing it off. Then, if no such cause external to the tubing is detected, a clog is suspected and its removal is attempted by flushing the feeding tube with a syringe filled with water or other flushing fluid. Next, if flushing fails to remove the clog, a mechanical means, such as a wire with a brush attached thereto, is inserted into the tube to push the clog out the distal end of the tube into the patient. This latter procedure, which is referred to herein as "Brush Removal", is limited to gastrostomy tubing, but there are risks associated with causing a hard object to be inserted into the patient's body. Few institutions have found these risks acceptable, so adoption of this technique is very limited.

If the clog cannot be removed by any of the above described measures, the indwelling feeding tube must be replaced. This results in patient discomfort and significant cost in terms of both equipment and the professional time required to carry out the replacement procedure.

There is a class of "flushing pumps" that attempt to reduce the incidence of clogging of indwelling feeding tubes by regularly interrupting normal feeding for a brief period of time and then flushing water through the feeding tube. See, for example, the Flexiflo® Quantum™ Enteral Pump Operating Manual (1993) from Ross Laboratories. Such a flushing pump is intended to keep clogs from building up over time, and after the brief flushing period, normal pumping is automatically reinstated. The amount of water and frequency of flushing is adjusted such that the patient is not over-hydrated. Typically, the flushing is performed once per hour, for 1½ minutes each time, and 25 ml of water is delivered to the patient.

This flushing flow rate is below the gravity feed rate of a typically sized (i.e., 8 french or larger) enteral feeding tube. Such a low flushing flow rate is unlikely to produce benefits that might be derived from the scouring action of forced, turbulent, higher pressure, flushing such as the effect generated by a flushing syringe connected to the feeding tube. Also, certain patients may be oversensitive to even the minimum amount of water that flushing pumps utilize, thereby precluding their use in such patients. In any event, when a clog does occur, such flushing pumps merely alert the nurse or other operator in the usual manner using an alarm. No automatic attempt is made by the flushing pump to remove clogs which have been detected.

SUMMARY OF THE INVENTION

It is an object of the present invention to provide a method for automatically removing clogs, detected as an obstruction in a feeding tube of a pumped fluid system, by controlling the pumping of the fluid.

Another object of the present invention is to reliably distinguish between pressure increases in the feeding tube due to effects of (i) high viscosity fluids, and (ii) obstructions such as clogs.

These and other objects are attained in accordance with one aspect of the invention which is directed to automatically clearing a tube in a pumped fluid system in response to detection of an obstruction. Fluid is pumped through the tube under pressure control. An obstruction signal is provided upon detection of an obstruction in the tube and, in response to the obstruction signal, a modified pressure control is applied to the fluid in the tube to urge a clog which is causing the obstruction to move and thereby to expel the clog from the tube.

Another aspect of the invention is directed to automatically clearing a tube in a pumped fluid system in response to detection of an obstruction. A fluid is pumped through the tube during a normal pumping cycle. An obstruction signal is provided upon detection of an obstruction in the tube and, in response to the obstruction signal, the normal pumping cycle is modified to urge a clog which is causing the obstruction to move and thereby to expel the clog from the tube.

A further aspect of the invention is directed to detecting an obstruction in a tube of a pumped fluid system. Fluid is pumped through the tube with a pumping cycle in one portion of which compliant components in the pumped fluid system are elastically expanded into an enlarged state due to raised fluid pressure therein. A measurement related to pressure is obtained in another portion of the pumping cycle in which, in the absence of an obstruction, the compliant components return toward a normal state from the enlarged state. A determination is made that an obstruction exists in the tube if the measurement exceeds a threshold level.

A still further aspect of the invention is directed to detecting an obstruction in a tube of a pumped fluid system. Fluid is pumped through a tube with a pumping cycle having one portion which forces more fluid into the tube than is expelled therefrom, and another portion in which a net outflow of fluid from the tube occurs, in the absence of an obstruction. A measurement related to pressure during the other portion of the pumping cycle is obtained, and a determination is made that an obstruction exists in the tube if the measurement exceeds a threshold level.

Yet another aspect of the invention is directed to detecting obstructions in a pumped system. A pump is provided having a pumping cycle that forces fluid from a pumping chamber into a tube during a compression stroke and at least partly refills the pumping chamber during a retraction stroke. The pump is controlled to pause for a selected period of time before the retraction stroke. A measurement related to pressure in the tube resulting from the pause is obtained, and a determination is made that an obstruction is present if the measurement exceeds a threshold level.

DETAILED DESCRIPTION OF THE PREFERRED EMBODIMENTS

As has been pointed out above, high pressure in the feeding tube can be caused by either a highly viscous fluid or an obstruction, or both. The present invention, broadly stated, takes advantage of the fact that the change in pressure over time during a pumping cycle due to a viscous fluid is different from the change in pressure over time during a pumping cycle due to an obstruction. In accordance with the invention, a measurement period is selected for measuring pressure when the contribution of viscosity has been diminished. Therefore, if the measured pressure at such time is still elevated, the cause is considered to be not viscosity but, rather, an obstruction. Stated another way, the present invention recognizes that in the absence of an obstruction even the most viscous fluid that can be used for a particular application, such as for nourishing a patient or for administering medication, will flow out of the feeding tube after some time has elapsed from completion of the compression stroke, for example, and thereby pressure in the tube will drop to an expected level. Thus, a measurement period is selected for measuring pressure downstream of the pump at a time during the pumping cycle when even such a viscous fluid should have flowed out. If, nevertheless, the pressure is still above the expected level, then this is taken to be an indication that the feeding tube is obstructed.

Various techniques are available for selecting the duration of this measurement period in accordance with the invention depending on the type of pump, the pump parameters, the desired flow rate, and the pumping cycle parameters. The preferred embodiment of the invention will now be described with respect to detecting an obstruction and to automatically clearing a clog in the feeding tube. This can be accomplished in accordance with the present invention by using the same pumped feeding-fluid system disclosed in U.S. Pat. Nos. 4,845,487 and 4,850,807, with certain changes as explained below.

Obstruction Detection During Normal Feeding Mode

Figure 6:
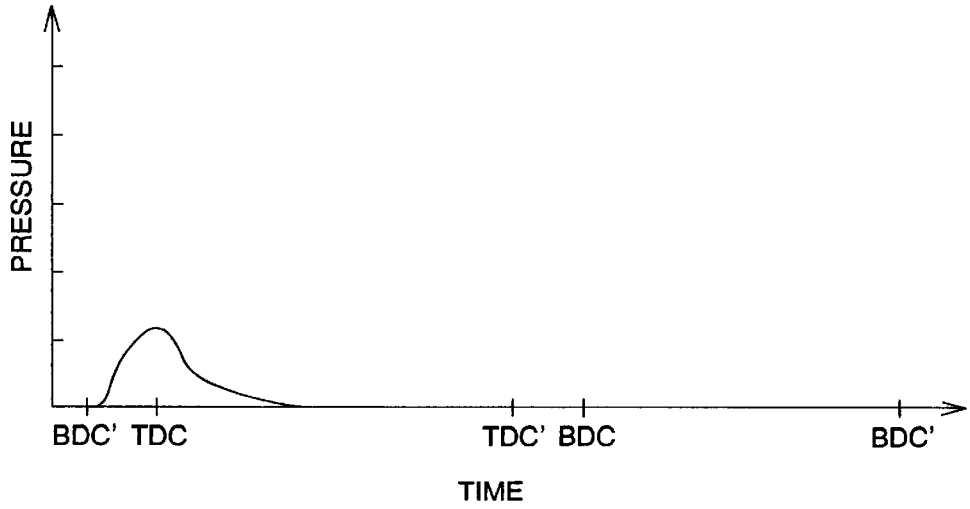
FIG. 6 is a graph similar to FIG. 4 showing the buildup and dissipation of pressure with respect to the pumping cycle, but with a pause in the pumping cycle being added in accordance with the invention, and for a no-clog condition.

As shown in the pressure graph of FIG. 6, the detecting technique of the preferred embodiment adds a pause between the points TDC and TDC' at the top of the chamber compression stroke (i.e., at point TDC) to allow time for the enlarged compliant components, including the feeding tube, to relax and expel feeding fluid, and for the effect due to Poiseuille's Law to dissipate. Valve 9 prevents the reverse flow of fluid into the pumping chamber. More specifically, when the piston 11 has been driven by the motor 10 to maximally compress the cassette bellows 7, the motor 10 is paused so that fluid in the feeding tube 6 is allowed sufficient time to be pushed out into the patient from the tubing. This pause is set to be sufficiently long so that during this period the feeding tube 6, which has been enlarged under pressure applied by the pumped feeding fluid, relaxes and pushes feeding fluid contained therein into the patient. The pressure in the feeding tube and, therefore, the cassette bellows, dissipates to a normal level, as shown in FIG. 6, given the fluid viscosity and if there is no obstruction.

The motor 10 then continues the pumping cycle to refill the pumping chamber during the retraction stroke between points TDC' and BDC.

The pumping cycle is then again controlled to provide the previously-described timed delay in the period between the points BDC and BDC'.

Figure 1:
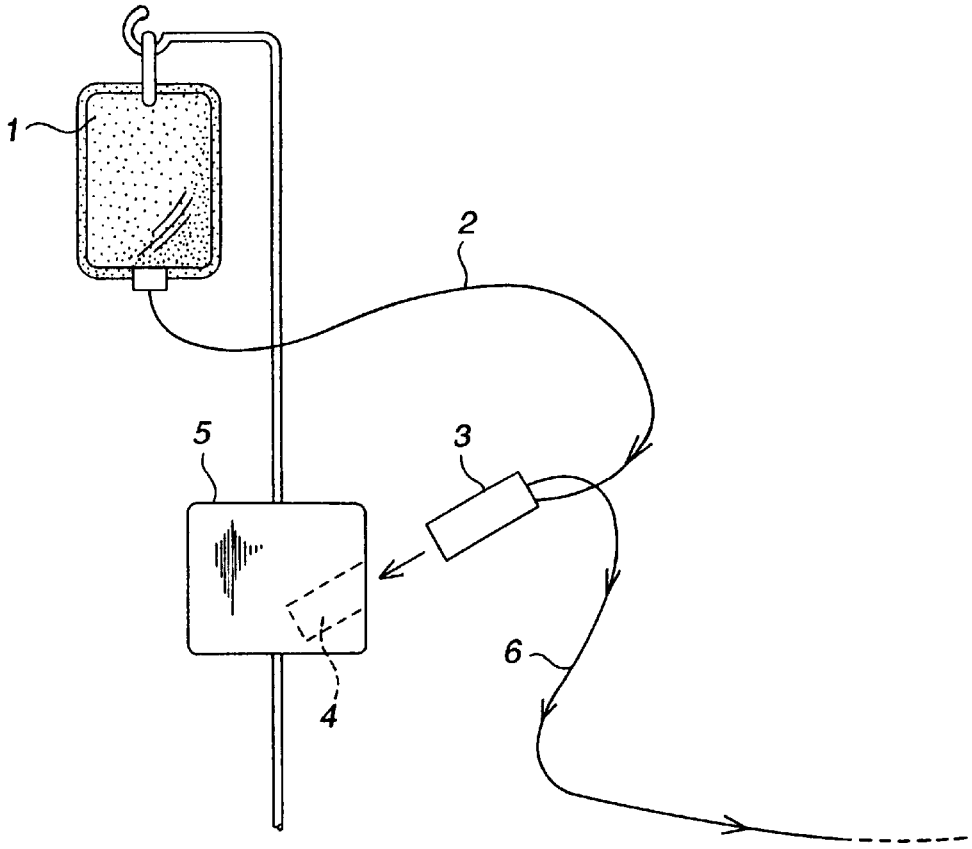
FIG. 1 (PRIOR ART)
FIG. 1 is a schematic view showing a prior art pumped fluid system for providing a fluid to a patient.
Figure 2:
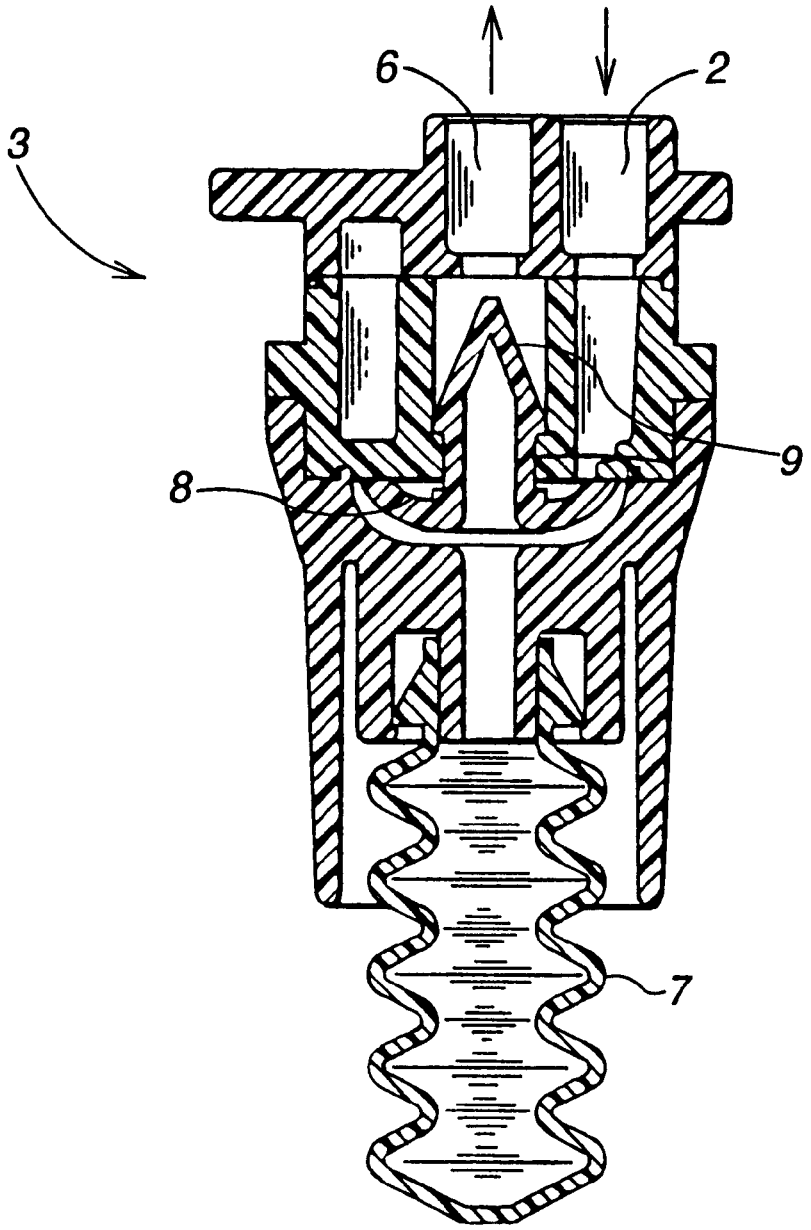
FIG. 2 (PRIOR ART)
FIG. 2 is a longitudinal cross-section of a prior art bellows cassette with which metered amounts of the fluid is pumped.
Figure 3:
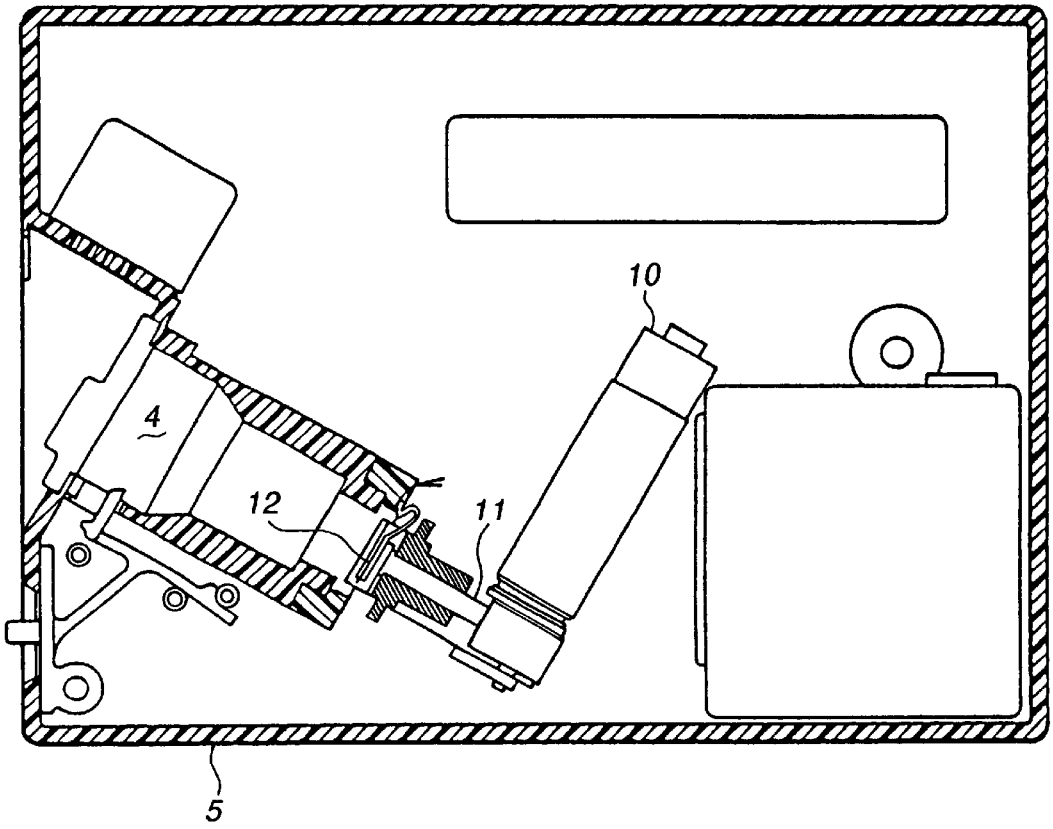
FIG. 3 (PRIOR ART)
FIG. 3 is a schematic cross-sectional view showing a pumping system housing with a chamber adapted to capture the bellows cassette of FIG. 2, so as to couple the cassette with a pumping motor and piston for pumping the fluid.
Figure 4:
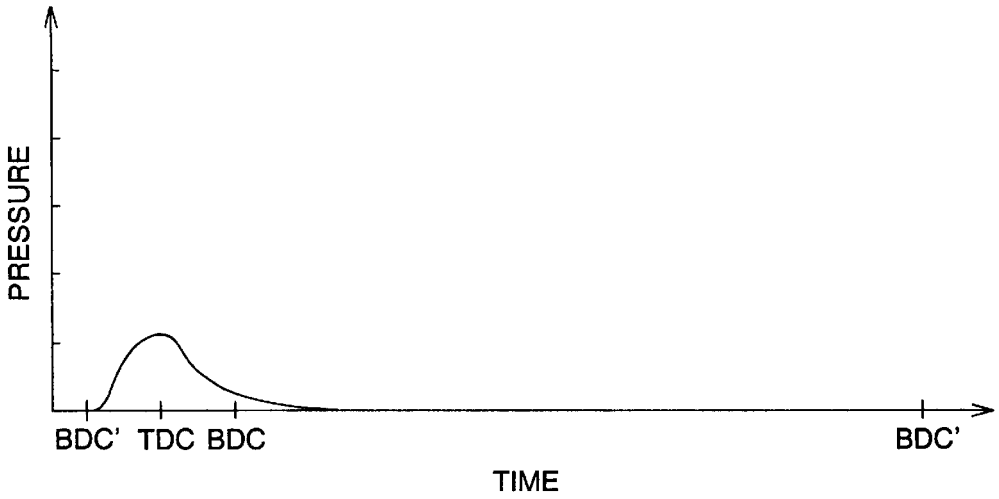
FIG. 4 is a graph showing the buildup and dissipation of pressure by the system of FIGS. 1–3 for a pumping cycle during a normal mode of feeding when no clogs are present in the feeding tube.
Figure 5:
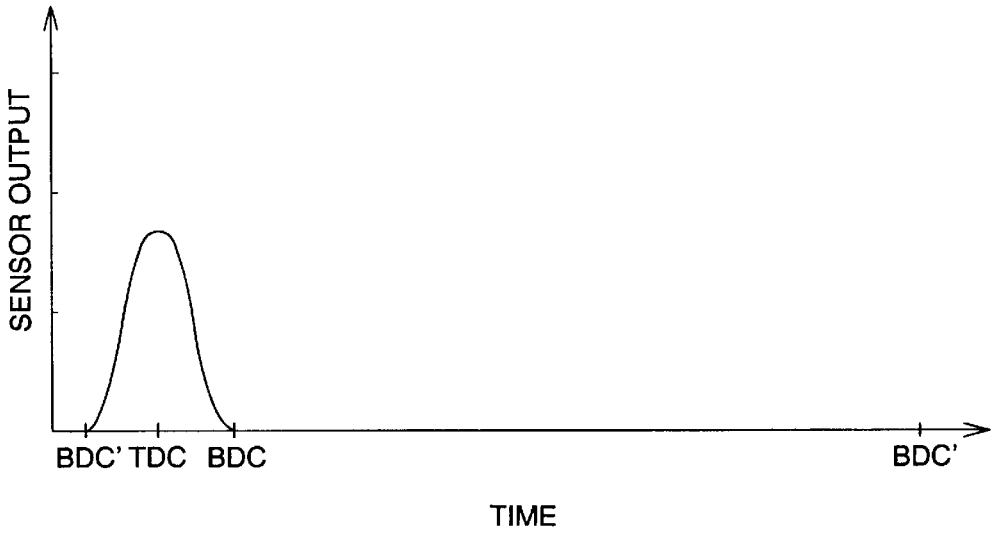
FIG. 5 is a graph showing the output of a piezoelectric transducer which detects pressure in the system of FIGS. 1–3 during a normal pumping cycle in a condition without any clogs such as shown in FIG. 4.
Figure 7:
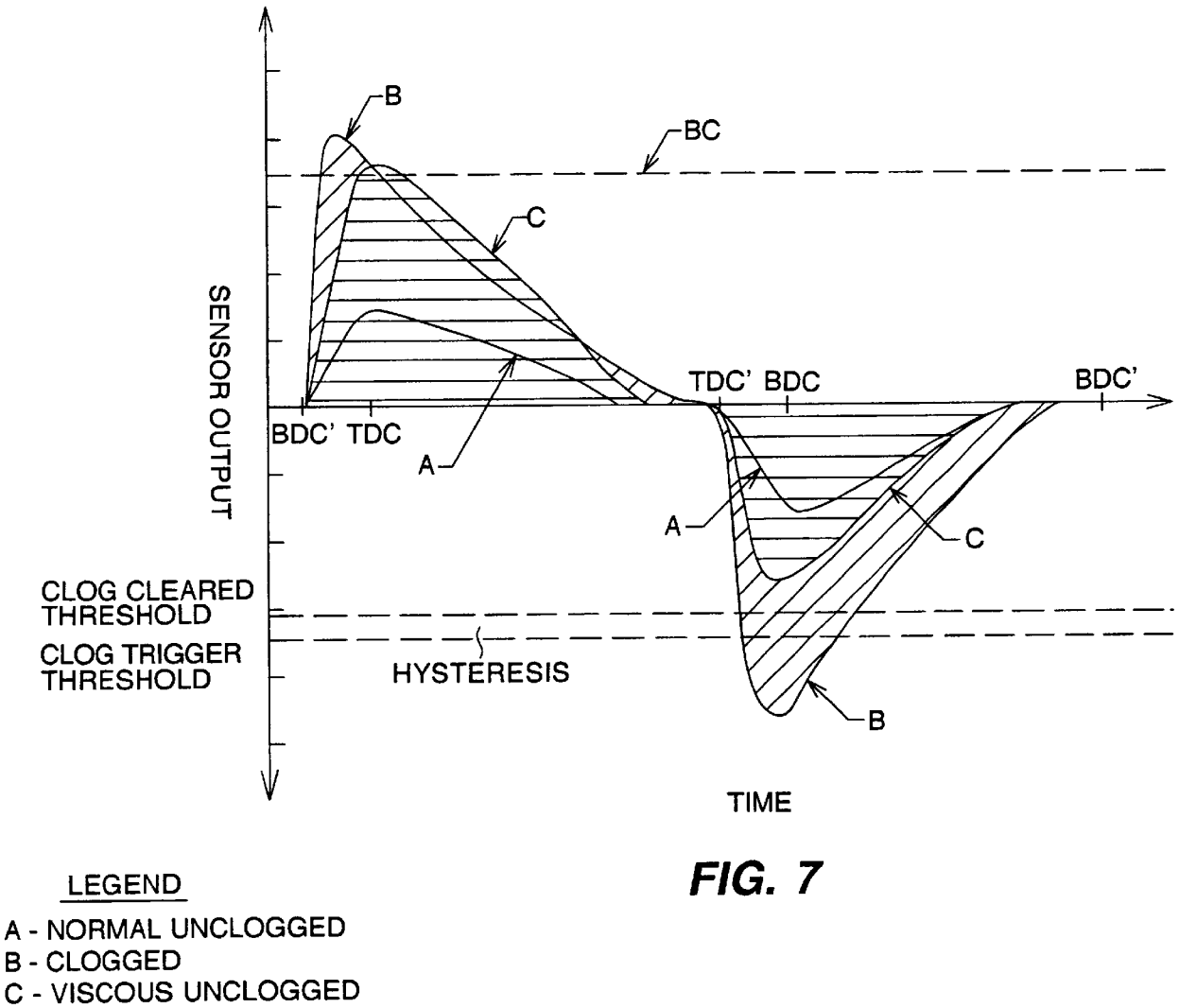
FIG. 7 shows three graphs of the piezoelectric transducer output, under respectively different conditions, for a pumping cycle controlled in accordance with the invention.

Curve A in FIG. 7 shows the output of piezoelectric transducer 12 for the pumping cycle of FIG. 6 when there is no obstacle and for a fluid with a relatively low viscosity. From BDC' to TDC the transducer output is similar to the output shown in FIG. 5. After TDC, and during the added pause, pressure drops as fluid is expelled from the tube. The transducer output drops toward zero in response to the pressure drop. During the retraction stroke, the transducer produces a negative signal due to the removal from the transducer of static force applied by the compressed bellows, and this reflects suction of fluid into the chamber. As the chamber fills, this signal also returns toward zero.

Let us now turn to a condition when an obstruction is present in the tubing. It should be understood that the present invention will detect an abnormality caused by any obstruction which reduces flow through the tubing, be it a crimped tube or a clog. The invention is described hereinafter with particularity in terms of clogs because this type of obstruction can be cleared automatically in accordance with the clearing aspect of the present invention, as described below. However, the detection aspect of the present invention will respond to any obstruction, including a clog, so that the system can react in order to either clear the obstruction in case of a clog, or otherwise alert the nursing staff that the patient's nutritional or medicinal needs are not being met.

Figure 8:
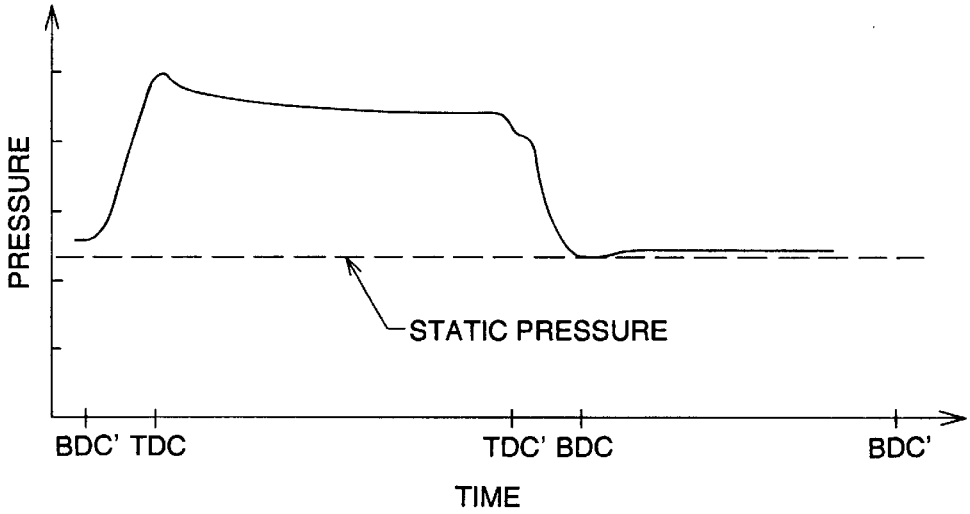
FIG. 8 is a graph showing changes in pressure with respect to the pumping cycle, but for a clogged condition.

When a clog is present, the pressure in the pumped fluid system will not dissipate to a normal level during the pause period because the fluid cannot be expelled normally from the feeding tube 6 into the patient due to the clog. As a result, the flexible feeding tube 6 of the fluid output system will enlarge and store energy. FIG. 8 illustrates the changes in pressure with respect to the pumping cycle after a clog has occurred and the system is beginning to see a static pressure. Curve B of FIG. 7 shows the corresponding output of piezoelectric transducer 12 for flow that is blocked.

As shown in FIG. 8, the pressure in bellows 7 remains high during the pause period added in accordance with the invention between points TDC and TDC'. This is because the fluid remaining in the feeding tube 6 cannot be expelled normally into the patient due to the presence of the clog or partial clog. Thus, during the retraction stroke, which occurs between point TDC' and point BDC, the pressure will drop somewhat, but maintains a large static component.

Curve B in FIG. 7 shows the output of piezoelectric transducer 12 for the pumping cycle of FIG. 8. The peak of curve B during the compression stroke BDC' to TDC depends on such factors as fluid viscosity, particulates in the fluid, partial clogs, temperature and system component variability influencing force on the transducer. Focusing in particular on the portion following TDC', one can readily discern that a large negative output signal is derived from the piezoelectric transducer 12. This large negative output signal is caused by a sudden release of static pressure on the piezoelectric transducer 12. When the large negative transducer output signal exceeds a preset clog trigger threshold level, a clog (or partial clog) is determined to be present and a clog clearing procedure may then be started automatically.

Compression of the pumping chamber is performed at a constant speed so as to prevent variation in the output of the piezoelectric transducer 12 due to any change in the rate of increasing pressure. Since the rate is held constant, any change in the output from the piezoelectric transducer 12 from one pumping cycle to another will indicate a change in the magnitude of the pressure.

Curve C in FIG. 7 shows how the transducer output signal varies during a pumping cycle of the present invention under a no-clog condition for a viscous fluid having a viscosity higher than that of the fluid used to derive curve A. The peak of curve C during the compression stroke BDC' to TDC depends on the same factors listed above for curve B.

In comparing curves B and C, a clear differentiation in the magnitude of the peak output signal can be discerned during the retraction stroke. In a particular configuration of components selected for experimentation, curve B reaches a peak of 1.65 volts whereas curve C reaches a peak of only 0.9 volts for a viscous fluid. No such clear differentiation is discernible in the compression stroke. This is explainable as follows.

During the compression stroke, both an obstruction and a relatively highly viscous fluid present a resistance to fluid flow which appears similar to a pressure sensor because the pressure buildup in either case is similar. Thus, the peaks reached by curves B and C are close in amplitude to each other, as shown in FIG. 7. Therefore, a threshold at line BC of FIG. 7 which is set for curve B may also be exceeded by curve C because it is difficult to find a level which is reliably exceeded by curve P but not by curve C. However, during the pause between TDC and TDC', even a relatively highly viscous fluid will have been expelled from the tube to an extent sufficient to drop the pressure to a value significantly lower than the pressure at TDC' of FIG. 8. Consequently, the difference in pressure encountered by the transducer during the retraction stroke due to a highly viscous fluid is lower when compared to such difference in the presence of an obstruction. Therefore, the transducer output after TDC' will have a much higher amplitude peak in the case of an obstruction. Thus, during a retraction stroke carried out after the pause, the difference between the peaks of curves B and C in FIG. 7 is much greater than the difference therebetween caused just by the compression stroke.

A threshold can therefore be set for discriminating between pressure increases during the retraction stroke due to increased viscosity of the feeding fluid and pressure increases due to clogs. This clog trigger threshold moreover, may be set such that even partial clogs which present a significant level of clogging (but which allow some fluid to flow therethrough or therearound) may be distinguished from a viscous fluid condition. Valves 8 and 9 limit the maximum system pressure to 30 psi. This pressure is indicative of a total clogged state. If a partial clog exists, the pressure in the system will drop during the pause between TDC and TDC' allowing pressure in bellows 7 to dissipate somewhat. As a result, the peak transducer output signal will also be lower during the retraction stroke. However, it may still be higher than curve C. Detection of partial clogs by properly selecting the threshold and the consequent automatic initiation of a clog clearing mode are advantageous because an early attempt at clearing a partial clog is more likely to be successful than if such action were delayed until a total clogged state is reached.

The clog trigger threshold can be set in any one of several ways based on various factors such as cost, contemplated usage(s), operator training. For example, it can be preset in the factory at a fixed level. It can also be made variable, and the operator presets it before use begins. Another possibility is to hook up the patient to the system and then run a calibration procedure (or learning period), when the feeding tube is known to be clear, to establish a base line under real conditions from which the threshold is derived. The same threshold is then maintained for the entire time that the system is used under the calibration conditions. Yet another approach utilizes a dynamically set threshold which periodically performs a calibration, or learning, operation to take into account real time conditions for setting the threshold. Since implementation of these alternatives is well within the capabilities of anyone with ordinary skill in the art, no details are deemed necessary.

To distinguish the signal output of the piezoelectric transducer for a clogged condition even more clearly from the pumping of a high viscosity fluid (without the occurrence of a clog), the above described pause is preferably inserted in the pumping cycle when the fluid pumping chamber is at maximum compression. As described above, this pause allows pressure which has built up in the feeding tube during the compression stroke to be dissipated. The expanded feeding tubing 6 will thus relax and any remaining feeding fluid will be pushed out into the patient, provided that the tube is not clogged. The amount of time needed for this pause is a function of the fluid viscosity.

The viscosity of feeding fluids ranges from 1.0 centipose for water to approximately 125 centipose for the most viscous of feeding fluids. This range of viscosity, in a typical flexible feeding tube, dictates a maximum pause of about 3.5 seconds to expel the full compression stroke of fluid and to bring the pressure to near zero.

Figure 9:
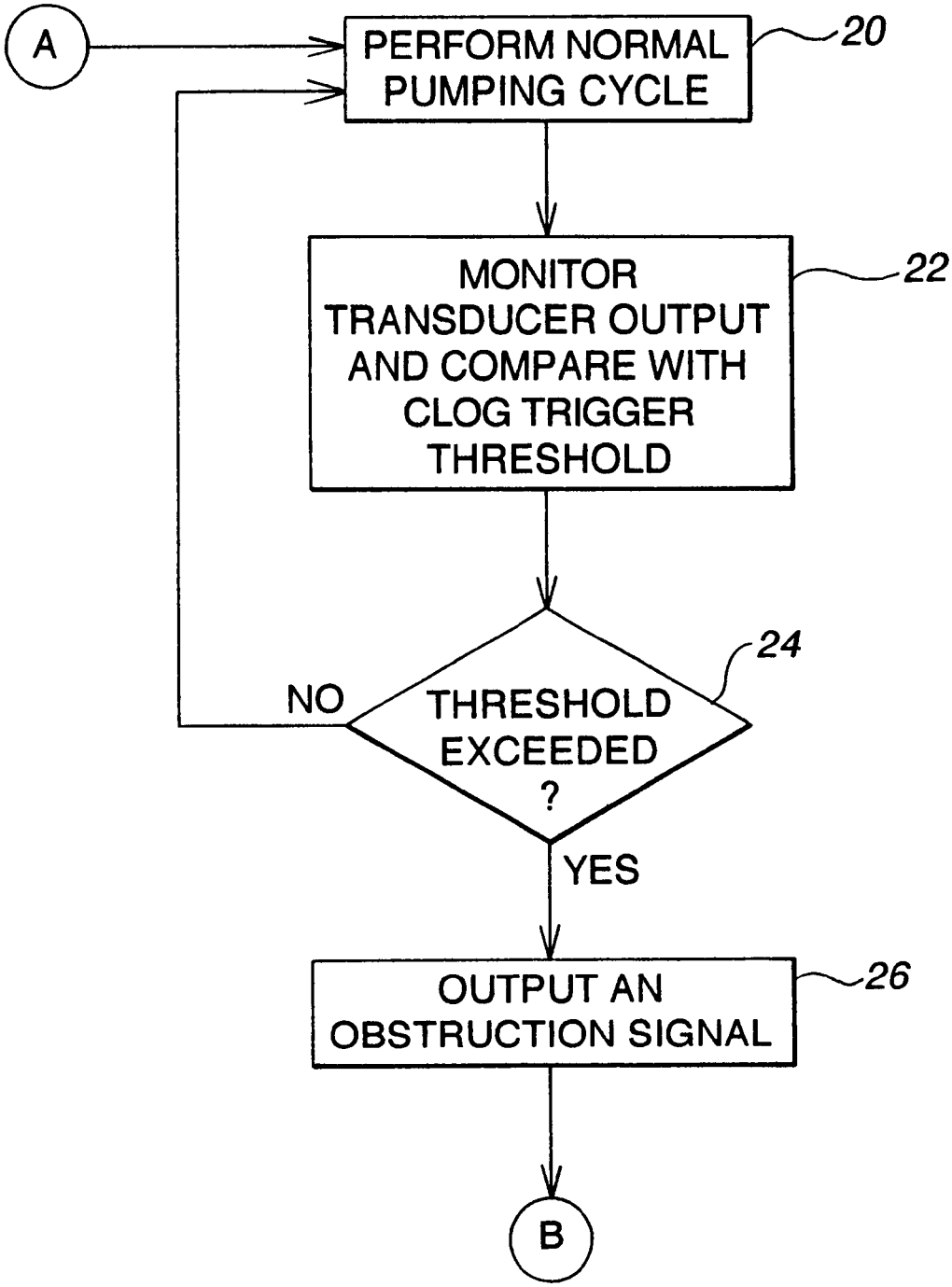
FIG. 9 shows a flowchart illustrating a series of control operations which are performed to effect obstruction detection.

FIG. 9 shows a flowchart illustrating a series of control operations which are performed to effect clog detection. Step 20 represents an operation for performing the above-described normal pumping cycle of FIG. 6 which includes the pause between TDC and TDC'. Step 22 monitors the output of piezoelectric transducer 12 and compares it with the clog trigger threshold during the selected measurement period between TDC' and BDC. If the threshold is exceeded, as per step 24, an obstruction signal is generated by step 26 which switches the pump into a clog clearing mode, as described below with regard to FIG. 10. If the threshold is not exceeded per step 24, then steps 22 and 24 are repeated in a loop while the pump is in operation.

After a clog is cleared by the system automatically, the normal pumping cycle is resumed automatically by returning to step 20 when the magnitude of the output of the piezoelectric transducer 12 is less than the clog-cleared threshold level (see FIG. 7), as explained below. If manual intervention is needed to clear the feeding tube, the pump must be restarted manually.

Clog Clearing Mode

Once a clog (including a partial clog) has been detected, a clog clearing mode is automatically initiated in accordance with the present invention. The pump is utilized to clear a clog automatically immediately following the detection of an obstruction, without requiring any assistance from a nurse or other operator. This is accomplished, moreover, using the pumped fluid system itself, with the same fluid that the pump has been feeding to the patient, and without requiring a separate flushing fluid or use of another mechanical device such as a syringe or a brush.

Thus, whereas detection of a clog would conventionally only trigger an alarm, according to the present invention the pumped fluid system will instead enter into a clog clearing mode and will remain in the clog clearing mode until either the clog has been removed or a preset period of time ("attempt period") for automatic clearing has expired, whichever occurs earlier.

Figure 10:
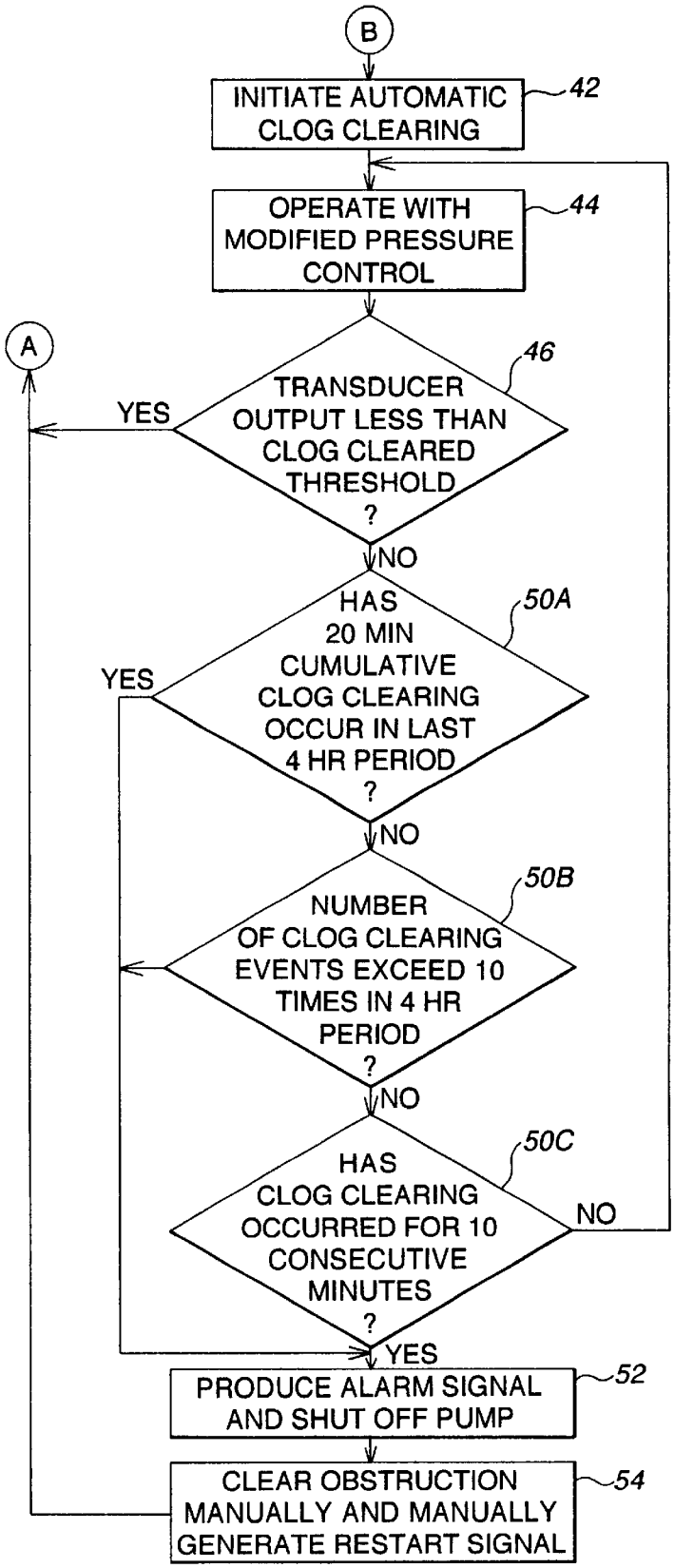
FIG. 10 shows a flowchart illustrating a series of control operations which are performed to effect automatic clog clearing.

FIG. 10 is a flowchart illustrating a series of control operations which are performed in response to an obstruction signal to effect automatic clog clearing. These control operations may be performed, for example, by a microprocessor.

In the clog clearing mode, the operation of the pump motor 10 is switched from the normal pumping cycle described above (see FIG. 9) to a clog clearing mode which relies on a modified pressure control. Step 42 responds to the obstruction signal produced by step 26 to switch the control program to one for automatically carrying out a clog clearance procedure. Step 44 controls the motor 10 to provide a modified pressure control.

The modified pressure control can be accomplished in accordance with one embodiment by more strongly pumping the fluid into the feeding tube 6 so as to apply more total pressure against the clog during the compression stroke than is applied by the normal pumping cycle. One way of applying more pressure is by actuating a burst of accelerated pumping action at a higher speed for motor 10 in reaction to the obstruction signal. Another way is to increase the driving stroke of the piston and, thereby, the compression of the bellows 7. The increased driving stroke could be accomplished with a greater offset to the cam to create a higher pumping pressure under all conditions, even during a normal pumping cycle, or the stroke could be made variable, such as by using a clutch, so that the stroke is increased responsive to the obstruction signal. The burst action and increased stroke could also be used in combination.

In a preferred embodiment of the modified pressure control mode, the modified pressure control is obtained by stopping the motor 10 in its maximum forward-stroke position wherein the cassette bellows 7 is held compressed so as to sustain high pressure in the feeding tube 6.

If, as a result of the modified pressure control the clog is caused to move slightly, or if a small leakage path around or through the clog is present or develops (i.e., as in the case of a partial clog), the pressure against the clog will eventually be reduced. In step 46, motor 10 is cycled after a fixed, preset time such as 3–4 sec. for commonly available feeding fluids at a typical flow rate. However, for different viscosities, particularly low viscosity fluids, a different fixed, preset time can be selected, which can even approach zero. This preset time is also affected by the selected flow rate. During such pumping cycle, the pressure will be detected by the piezoelectric transducer 12. If step 46 determines that the clog has not been cleared because the magnitude of the transducer output signal is above the clog-cleared threshold (as explained below), motor 10 will wait for the preset time to expire and then cycle again. During these pumping cycles, the cassette bellows 7 refills with is fluid and to the extent that some fluid has leaked around a clog and out of the tube, more fluid will be pumped into the clogged feeding tube 6. High pressure remains in the feeding tube as long as the clog is not cleared and, therefore, the clog-cleared threshold is exceeded.

Due to the theological properties of clogs, it typically requires both time and pressure (e.g., sustained pressure) to move a clog completely out of a feeding tube. In practice, it is common for a clog to eventually form along substantially the full length of the feeding tube. Thus, to remove such a clog, sufficient fluid must be injected by the pump into the feeding tube at the anterior end of the feeding tube to replace the volume of clog material as it is pushed out the distal end of the feeding tube.

According to the present invention, the pressure exerted on the clog is preferably limited so as not to exceed safe levels with respect to both the patient and the pumped fluid system. Specifically, the assembly for valves 8 and 9 is fitted within the cassette 3 in a manner so as not to allow the pump to increase pressure above a maximum pressure of, for example, 30 psi. If the clog has been cleared, step 46 will determine that the magnitude of the output signal from the piezoelectric transducer 12 during a retraction stroke has dropped to less than the clog-cleared threshold level shown in FIG. 7. Typically, the clog-cleared threshold has an amplitude less than the clog trigger level, and the difference between the two levels provides hysteresis (i.e., a dead band) for system stability. After the clog is cleared, moreover, the pump motor 10 is automatically returned to its normal pumping cycle by step 46.

If the clog is not cleared within a preset "attempt period", then an alarm is activated by step 52 in the conventional manner to alert a nurse or other operator that the system is malfunctioning. This automatic clog clearing "attempt period" is set as follows.

Step 50A determines for a sliding time duration of the immediately preceding 4 hours, during which several clogs may have been detected and cleared, whether a total of 20 mins. has been accumulated on the task of clog clearing. In step 50B, each clog event within that sliding 4 hour period is recorded, and a maximum of 10 events is tolerated. In step 50C, a determination is made whether the present clog clearing mode has continued for 10 consecutive minutes. If any of steps 50A, 50B and 50C produces a yes result, step 52 is actuated. Otherwise, clog clearing continues by returning to step 44.

Of course, if the obstruction has been caused externally by an object placed on the feeding tube 6 or by a crimp in the tube, the automatic clog clearing technique of the present invention will not clear this obstruction.

After the automatic clog clearing attempt period has expired and the alarm has been activated, all pumping action is terminated per step 52. The nurse or other operator would then follow a conventional clearing protocol per step 54.

When the obstruction is manually cleared, a signal is manually generated to resume the normal pumping cycle.

As described hereinabove, according to the technique of the present invention, the pumped fluid system is utilized to clear a clog automatically immediately following the detection of an obstruction, utilizing the fluid in the system which is being pumped to the patient, without any assistance from a nurse or other operator. Thus, the present invention provides three major advantages over normal manual clog clearing using a syringe. First, this invention enables valuable nursing time to be saved. Second, since there is no delay before the clog clearing action is taken, the chance of clearing a clog is enhanced since, in general, the longer a clog remains in place, the more difficult it is to remove, even with the mechanical assistance of a syringe. Third, the patient's situation is improved, as the fluid delivery is not compromised during the period of alarm detection and manual intervention.

The present invention also has advantages compared to the alternative non-syringe devices. The following Table 1 compares the present invention to these other devices as all three relate to manual intervention with a syringe once a clog has formed.

TABLE 1

ADVANTAGES OF VARIOUS ALTERNATIVES TO SYRINGE CLOG-CLEARING

| | Invention | Flushing Pumps | Brush |
|---|---|---|---|
| NURSING TIME | Saves nursing time | No savings if routine flushing fails to prevent clogs | No savings. |
| CLOG-CLEARING EFFECTIVENESS | Real-time action prevents clogs from hardening. | If clog forms, delayed response allows for hardening. | Delayed response allows for clog hardening. |
| COST | No incremental costs. Reduces incidence of feeding tube replacement | Expensive dual bag sets. Reduces incidence of feeding tube replacement. | Brush kit expense. Only effective with gastrostomy tubes. |
| PATIENT COMFORT | Reduces incidence of feeding tube replacement | Reduces incidence of feed ing tube replacement. | Only effective with gastrostomy tubes. |
| PATEINT FLUID REQUIREMENTS | Provides acceptable fluid requirements. | If clog forms, reduced fluid delivery during manual clog clearing. | Reduced fluid delivery during manual clog clearing. |

Although preferred embodiments of the present invention have been discussed in detail below, various modifications thereto will be readily apparent to one with ordinary skill in the art. For example, it is not necessary to have a complete pause between TDC and TDC'. The motor could just be slowed sufficiently so that in the absence of a clog a viscous fluid can flow out of the feeding tube. Also, the measurement period need not occur during the retraction stroke but can even occur during a compression stroke, as long as the compression is variable and the level of compression has been sufficiently decreased such that a viscous fluid would normally have an opportunity to have a net outflow which reduces pressure in the feeding tube in the absence of a clog. These and other such modifications are all intended to fall within the scope of the present invention as defined by the following claims.

We claim:

1. A method of automatically clearing a tube in a pumped fluid system in response to detection of an obstruction, comprising the steps of:

pumping a fluid through the tube under pressure control;

providing an obstruction signal upon detection of an obstruction in the tube; and in response to said obstruction signal, applying a modified pressure control to the fluid in the tube to urge a clog which is causing the obstruction to move and thereby to expel the clog from the tube.

2. The method of claim 1, wherein the modified pressure control is applied by the same pump used for said pumping step.

3. The method of claim 1, wherein the step of modifying the pressure control comprises applying a sustained pumping pressure.

4. The method of claim 1, wherein the modified pressure control is stopped after a predetermined time period if the tube is not cleared, and an alarm signal is generated.

5. A method of automatically clearing a tube in a pumped fluid system in response to detection of an obstruction, comprising the steps of:

pumping a fluid through the tube during a normal pumping cycle;

providing an obstruction signal upon detection of an obstruction in the tube; and in response to said obstruction signal, modifying the normal pumping cycle to urge a clog which is causing the obstruction to move and thereby to expel the clog from the tube.

6. The method of claim 5, wherein the normal pumping cycle comprises a compression stroke for expelling the fluid from a fluid chamber of the pump into the feeding tube under pressure and a retraction stroke for refilling the pumping chamber, and wherein the step of modifying the normal pumping cycle comprises sustaining pumping pressure in the tube.

7. The method of claim 6, wherein the step of sustaining pumping pressure comprises delaying the start of the retraction stroke.

8. The method of claim 5, wherein the step of modifying the normal pumping cycle comprises sustaining pumping pressure in the tube.

9. The method of claim 8, wherein the step of sustaining pumping pressure comprises obtaining a measurement related to pressure in the tube and, if the measurement exceeds a threshold, continuing to sustain said pumping pressure.

10. The method of claim 9, wherein the step of continuing to sustain said pumping pressure comprises introducing more of the fluid into the tube if fluid has leaked around the clog.

11. The method of claim 8, wherein the pumping pressure is sustained only for a predetermined attempt period and an alarm is triggered if the predetermined attempt period expires without the tube being cleared.

12. The method of claim 11, wherein the predetermined attempt period is set as a maximum duration for continuing to clear one clog.

13. The method of claim 11, wherein the predetermined attempt period is set as a maximum cumulative duration for clearing a plurality of clogs over a designated period of time.

14. The method of claim 11, wherein the predetermined attempt period is set as a maximum number of attempts to clear a plurality of clogs over a designated time period.

15. The method according to claim 5, wherein the step of modifying the normal pumping cycle comprises lengthening a driving stroke of a piston of the pump.

16. The method of claim 5, wherein the step of modifying the normal pumping cycle comprises increasing the speed of the compression stroke of the pump.

17. The method of claim 5, wherein the step of modifying the normal pumping cycle comprises periodically obtaining a measurement related to fluid pressure in the tubing and, when the measurement drops below a threshold, returning to the normal pumping cycle.

18. A method of automatically clearing a tube in a pumped fluid system in response to detection of an obstruction, comprising the steps of:

pumping a fluid through the tube under pressure;

providing an obstruction signal upon detection of an obstruction in the tube; and in response to said obstruction signal, modifying the pressure applied to the fluid in the tube to urge a clog which is causing the obstruction to move and thereby to expel the clog from the tube.

19. Apparatus for automatically clearing a tube in a pumped fluid system in response to detection of an obstruction, comprising:

means for pumping a fluid through the tube under pressure control;

means for providing an obstruction signal upon detection of an obstruction in the tube; and means for applying a modified pressure control to the fluid in the tube, in response to said obstruction signal, to urge a clog which is causing the obstruction to move and thereby to expel the clog from the tube.

20. Apparatus for automatically clearing a tube in a pumped fluid system in response to detection of an obstruction, comprising:

means for pumping a fluid through the tube during a normal pumping cycle;

means for providing an obstruction signal upon detection of an obstruction in the tube; and means for modifying the normal pumping cycle, in response to said obstruction signal, to urge a clog which is causing the obstruction to move and thereby to expel the clog from the tube.

21. Apparatus for automatically clearing a tube in a pumped fluid system in response to detection of an obstruction, comprising:

means for pumping a fluid through the tube under pressure;

means for providing an obstruction signal upon detection of an obstruction in the tube; and means for modifying the pressure applied to the fluid in the tube, in response to said obstruction signal, to urge a clog which is causing the obstruction to move and thereby to expel the clog from the tube.

22. A method for detecting an obstruction in a tube of a pumped fluid system, comprising the steps of:

pumping fluid through the tube with a pumping cycle in one portion of which compliant components of the pumped fluid system are elastically expanded into an enlarged state due to raised fluid pressure therein;

obtaining a measurement related to pressure in another portion of the pumping cycle in which, in the absence of an obstruction, the compliant components return toward a normal state from said enlarged state; and determining that an obstruction exists in the tube if said measurement exceeds a threshold level.

23. The method of claim 22, wherein said measurement is obtained in every pumping cycle.

24. The method of claim 22, wherein said compliant components return toward the normal state during said other portion of the pumping cycle in which a net outflow of fluid from the tube occurs, in the absence of an obstruction.

25. The method of claim 23, wherein said pumping cycle includes a compression stroke to push fluid out of the pump and into the tube, a retraction stroke to refill the pump with fluid, and a pause after the compression stroke.

26. The method of claim 25, wherein said pause has a duration sufficiently long to enable highly viscous fluid to be expelled from the tube as the compliant components return toward the normal state, in the absence of an obstruction.

27. The method of claim 26, wherein said measurement is obtained during said retraction stroke.

28. The method of claim 26, wherein said pause begins at a point of maximum compression reached by said compression stroke.

29. The method of claim 22, wherein said threshold is set to be greater than a peak level which can be reached by said obtained measurement which is influenced by viscosity rather than clogging.

30. The method of claim 29, wherein said threshold is set to be below a magnitude of a peak level which can be reached by said obtained measurement which is influenced by clogging.

31. A method of detecting an obstruction in a tube of a pumped fluid system, comprising the steps of:

pumping fluid through a tube with a pumping cycle having one portion which forces more fluid into the tube than is expelled therefrom, and another portion in which a net outflow of fluid from the tube occurs, in the absence of an obstruction;

obtaining a measurement related to pressure during said other portion of the pumping cycle; and determining that an obstruction exists in the tube if said measurement exceeds a threshold level.

32. The method of claim 31, wherein said measurement is obtained during said other portion at a time when the effect of viscosity on said measurement has been substantially reduced.

33. A method of detecting obstructions in a pumped system, comprising the step of:

providing a pump having a pumping cycle that forces fluid from a pumping chamber into a tube during a compression stroke and at least partly refills the pumping chamber during a retraction stroke;

controlling the pump to pause for a selected period of time before the retraction stroke;

obtaining a measurement related to pressure in the tube resulting from the pause; and determining that an obstruction is present if the measurement exceeds a threshold level;

wherein the period of time for said pause is selected to be long enough for the pressure in the tube to dissipate in a no-obstruction condition, even for a high viscosity fluid.

34. The method of claim 33, wherein said pause begins at a point of maximum compression of the fluid in said compression stroke.

35. The method of claim 33, wherein said measurement is taken during the retraction stroke.

36. A method of detecting obstructions in a pumped system, comprising the steps of:

providing a pump having a pumping cycle that forces fluid from a pumping chamber into a tube during a compression stroke and at least partly refills the pumping chamber during a retraction stroke;

controlling the pump to pause for a selected period of time before the retraction stroke;

obtaining a measurement related to pressure in the tube resulting from the pause; and determining that an obstruction is present if the measurement exceeds a threshold level;

wherein the period of time for said pause is selected to enable a substantial amount of the fluid to be expelled from the tube in the absence of an obstruction, even for a high viscosity fluid.

37. The method according to claim 33, wherein the threshold level is set at a value which is low enough to detect partial clogs.

38. Apparatus for detecting an obstruction in a tube of a pumped fluid system, comprising:

means for pumping fluid through the tube with a pumping cycle in one portion of which the tube is elastically expanded into an enlarged state due to raised fluid pressure therein;

means for obtaining a measurement related to pressure in another portion of the pumping cycle in which, in the absence of an obstruction, the tube returns toward a normal state from said enlarged state; and means for determining that an obstruction exists in the tube if said measurement exceeds a threshold level.

39. Apparatus for detecting an obstruction in a tube of a pumped fluid system, comprising:

means for pumping fluid through a tube with a pumping cycle having one portion which forces more fluid into the tube than is expelled therefrom, and another portion in which a net outflow of fluid from the tube occurs, in the absence of an obstruction;

means for obtaining a measurement related to pressure during said other portion of the pumping cycle; and means for determining that an obstruction exists in the tube if said measurement exceeds a threshold level.

40. Apparatus for detecting obstructions in a pumped system, comprising:

means for providing a pump having a pumping cycle that forces fluid from a pumping chamber into a tube during a compression stroke and at least partly refills the pumping chamber during a retraction stroke;

means for controlling the pump to pause for a selected period of time before the retraction stroke;

means for obtaining a measurement related to pressure in the tube resulting from the pause; and means for determining that an obstruction is present if the measurement exceeds a threshold level;

wherein the selected period of time for said pause is long enough for the pressure in the tube to dissipate in a no-obstruction condition, even for a high viscosity fluid.

41. Apparatus for detecting obstructions in a pumped system, comprising:

means for providing a pump having a pumping cycle that forces fluid from a pumping chamber into a tube during a compression stroke and at least partly refills the pumping chamber during a retraction stroke;

means for controlling the pump to pause for a selected period of time before the retraction stroke;

means for obtaining a measurement related to pressure in the tube resulting from the pause; and means for determining that an obstruction is present if the measurement exceeds a threshold level;

wherein the selected period of time for said pause enables a substantial amount of the fluid to be expelled from the tube in the absence of an obstruction, even for a high viscosity fluid.

* * * * *